US010099078B1

(12) United States Patent
Blanchat

(10) Patent No.: US 10,099,078 B1
(45) Date of Patent: Oct. 16, 2018

(54) COMPRESSED AIR FOAM MIXING DEVICE

(71) Applicant: Gregory A. Blanchat, Harper, KS (US)

(72) Inventor: Gregory A. Blanchat, Harper, KS (US)

( * ) Notice: Subject to any disclaimer, the term of this patent is extended or adjusted under 35 U.S.C. 154(b) by 8 days.

(21) Appl. No.: 15/295,583

(22) Filed: Oct. 17, 2016

Related U.S. Application Data

(63) Continuation-in-part of application No. 14/802,424, filed on Jul. 17, 2015, now abandoned.

(51) Int. Cl.
*A62C 31/12* (2006.01)
*A62C 5/02* (2006.01)
*B05B 7/00* (2006.01)

(52) U.S. Cl.
CPC ..... *A62C 5/022* (2013.01); *A62C 31/12* (2013.01); *B05B 7/0025* (2013.01)

(58) Field of Classification Search
CPC .. Y10S 261/26; Y10S 261/75; B01F 3/04446; B01F 5/0406; A62C 5/022; A62C 31/12; B05B 7/0025
USPC ..... 169/14
See application file for complete search history.

(56) References Cited

U.S. PATENT DOCUMENTS 664,237 A 12/1900 Deming
2,137,338 A 11/1938 Gosmann
2,183,561 A 12/1939 Hamblin
2,386,464 A 10/1945 Hogenmiller
2,513,417 A 7/1950 Lindsay
2,936,835 A 5/1960 Sheppard
2,967,570 A * 1/1961 Nurkiewicz ..... A62C 31/005 169/15
3,234,962 A 2/1966 Williamson
3,337,195 A 8/1967 Farison
3,361,412 A 1/1968 Cole
3,558,053 A * 1/1971 Hruby, Jr. ..... B01F 3/0473 239/17
3,701,482 A 10/1972 Sachnik
3,749,378 A 7/1973 Rhodes
3,836,076 A 9/1974 Conrad et al.
3,856,270 A 12/1974 Hemker
3,945,567 A * 3/1976 Rambach ..... F04F 5/466 239/132.5

(Continued)

FOREIGN PATENT DOCUMENTS

CA 2341269 5/2007

*Primary Examiner* — Chee-Chong Lee
(74) *Attorney, Agent, or Firm* — Robert O. Blinn

(57) ABSTRACT

A compressed air foam (CAF) mixing device is suitable for use in a CAF system which includes a pressurized source of a water soap mixture and a pressurized air source. The CAF mixing device includes an inlet portion, a venturi portion and a deceleration portion. The venturi portion communicates with the inlet portion and includes a constricted zone which presents a smaller cross sectional area than the inlet portion. The venturi portion opens into the deceleration portion which has a substantially larger cross sectional area than the venturi portion. At least one pressurized air conduit communicates with the pressurized air source and is arranged to be adjacent to the deceleration portion. At least one aperture which communicates between the pressurized air conduit and the deceleration portion introduces high pressure air into the deceleration portion in order to produce a water soap foam (CAF) suitable for firefighting.

14 Claims, 4 Drawing Sheets

(56) References Cited

U.S. PATENT DOCUMENTS

| | | | | | |
|---|---|---|---|---|---|
| 4,033,714 | A | * | 7/1977 | Longworth | F23D 14/04 122/17.1 |
| 4,147,478 | A | | 4/1979 | Vork | |
| 4,318,443 | A | | 3/1982 | Cummins | |
| 4,330,086 | A | | 5/1982 | Nysted | |
| 4,361,407 | A | | 11/1982 | Pellegrini | |
| 4,375,438 | A | | 3/1983 | McKay | |
| 4,422,191 | A | * | 12/1983 | Jaworski | A61H 33/027 239/428.5 |
| 4,474,680 | A | | 10/1984 | Kroll | |
| 4,807,814 | A | * | 2/1989 | Douche | B05B 7/1486 239/428 |
| 4,828,038 | A | * | 5/1989 | Williams | A62C 31/12 169/14 |
| 4,830,790 | A | * | 5/1989 | Stevenson | B01F 5/0408 169/15 |
| 4,830,890 | A | | 5/1989 | Stevenson | |
| 4,968,458 | A | | 11/1990 | Besnia | |
| 5,382,389 | A | | 1/1995 | Goodine | |
| 5,445,226 | A | | 8/1995 | Scott et al. | |
| 5,837,168 | A | | 11/1998 | Rowe | |
| 5,900,191 | A | | 5/1999 | Gray et al. | |
| 6,042,089 | A | | 3/2000 | Klein | |
| 6,086,052 | A | | 7/2000 | Rowe | |
| 6,276,459 | B1 | | 8/2001 | Bradford et al. | |
| 6,602,916 | B2 | | 8/2003 | Grundmann et al. | |
| 8,919,745 | B1 | | 12/2014 | Rowe | |

* cited by examiner

COMPRESSED AIR FOAM MIXING DEVICE

CROSS REFERENCES TO RELATED APPLICATIONS

This application is a continuation-in-part of U.S. patent application Ser. No. 14/802,424 filed on Jul. 17, 2015 which is incorporated herein by reference.

FIELD

This invention relates to a device for mixing a water and soap mixture with pressurized air to generate compressed air foam (CAF) for fighting fires.

BACKGROUND

Compressed air foam systems (CAFS) are used for fighting fires. CAFS are simply a means for mixing compressed air and mixture of water and soap concentrate in order to produce a water-based foam that is used to extinguish fires. The three elements which must be present for a fire to continue burning, which are often referred to as "the fire triangle" are (a) fuel, (b) oxygen and (c) heat. Compressed air foam (CAF) is more effective for extinguishing a fire than plain water or even a mixture of water and soap concentrate because CAF addresses all three elements of the fire triangle. CAF is highly effective because it does the following:

(a) coats the fuel, thus cooling it below the temperature for combustion, (b) blankets the fuel, separating it from the oxygen that is required to keep it burning which also prevents the outgassing of combustible gasses, (c) cools a superheated environment by creating steam with the application of water-based foam.

Another advantage that CAF has over plain water is that water damage and runoff is dramatically decreased. For example, if there is a fire in the attic of a structure, the water used to put out the fire that has not evaporated or turned to steam will seep down into the parts of the structure below the attic. This water damage may end up being more severe than the damage caused solely by the fire. CAF is a foamy solution which does not run as quickly as plain water, depending on its consistency. A very dry CAF will stay in place like a blanket for hours whereas a very wet CAF may runoff in a matter of minutes. Additionally, because CAF is a mixture of water and soap concentrate and air, it by definition does not contain as much water per unit volume as water alone while maintaining a much greater suppression capability.

CAFS can deliver a range of useful consistencies, from very dry to very wet by controlling the air to water and soap concentrate ratio. Very wet CAF is often used for initial attack to immediately cool the fuel and atmosphere. Dry CAF has a very long drain time—the bubbles do not burst and lose their water quickly which is effective when used as a blanket to separate the fuel from oxygen, to protect exposed fuel from advancing fire and to prevent outgassing of the superheated materials.

CAF bubble structure is significant for its ability to be used effectively. The mixing of air into a soapy water concentrate allows for the formation of bubbles which have a significantly greater surface area of water cooling agent, allowing for greater heat reduction versus equal amounts of water. A mix with smaller bubbles has more surface area for cooling agent than a mix with large bubbles, thus it is preferred to achieve a homogeneous mix with very small bubbles for maximum effectiveness. A good CAF mix could be described as resembling shaving cream.

CAFS can be particularly valuable for fire departments because the use of foam reduces the amount of water required to extinguish a fire in areas where water sources may be limited or nonexistent as well as allow for less manpower to achieve a quick knockdown of the threat prior to the arrival or more equipment and personnel. CAF is estimated to be superior for fire knockdown by a factor of 10.400 gallons of water made into CAFS can extinguish roughly as much fire as 4000 gallons of plain water with the same size pump and equipment.

In order for CAF to be created and mixed (known as scrubbing) thoroughly, the water/soap concentrate and air pressures must be equal. This has been a problem for many Compressed Air Foam (CAF) system manufacturers because they have incorporated balancing valves, pressure regulators and manual adjustments or other electronics to achieve the precise pressures for mixing. Relying on these types of components or human interaction with the system to make it work correctly, introduces more potential failure points and creates a troubleshooting nightmare. Many such CAF systems require minimum hose lengths for additional scrubbing so that the correct CAF texture is achieved at the nozzle. Often, due to the complex plumbing and components or flow restrictions, CAF systems are not capable of flowing plain water without air injection for scenarios where it is preferred to use water or water and soap concentrate alone. This requires the apparatus to have a separate plumbing system for CAF only. For these reasons, CAF systems have gained a bad reputation in firefighting for being unreliable and difficult to operate.

For the aforementioned reasons, it is desirable to develop a mixing device which:

(a) successfully introduces compressed air into a flowing mixture of water and soap concentrate, (b) mixes the mixture of water and soap concentrate and compressed air to create an ideal bubble structure prior to exiting the device, (c) has limited moving parts and requires minimal maintenance, (d) allows for plain water or water/soap concentrate to pass through at maximum flow with the compressed air system and/or soap injection system deactivated, and, (e) allows for easy mechanical adjustment of the air to water/soap concentrate ratio for wet to dry adjustment.

SUMMARY

The above noted need is addressed by a CAF mixing device which is adapted for use in a CAF system which includes a source of a water and soap mixture and a pressurized air source. The CAF mixing device has a body which presents a channel which extends from an inlet to an outlet. The inlet is in communication with a source of a water and soap mixture and the outlet is suitable for presenting CAF suitable for use by a firefighting apparatus. The channel includes an inlet portion, a venturi portion and a deceleration portion. The inlet portion extends between the inlet and the venturi portion and has a first cross sectional area. The venturi portion communicates with the inlet portion and includes a constricted zone. The constricted zone has a second cross sectional area which is substantially less than the first cross sectional area. The venturi portion discharges into the deceleration portion. The deceleration portion has a third cross sectional area which is substantially greater than the second cross sectional area. The deceleration portion also communicates with the outlet. At least one pressurized air conduit which is in communication with pressurized air supply is arranged to be adjacent to the deceleration portion. At least one aperture communicates between the at least one pressurized air conduit and the deceleration portion for introducing high pressure air into the deceleration portion. As pressurized air is injected into the turbulent flow of the water soap mixture within the deceleration portion, a water soap foam is generated which consists of a very large number of very small thin-walled water/soap bubbles.

Accordingly, a water soap mixture is able to flow into the inlet portion of the CAF mixing device at a first flow velocity, accelerate in the venturi portion to a second velocity which is higher than the first velocity then decelerate in a highly turbulent fashion in the deceleration portion as pressurized air is introduced into the deceleration portion such that water soap foam composed of a myriad of water soap bubbles is generated within the device and discharged from the outlet thereby generating compressed air foam of the type which is effective for fighting fires.

DETAILED DESCRIPTION

Figure 1:
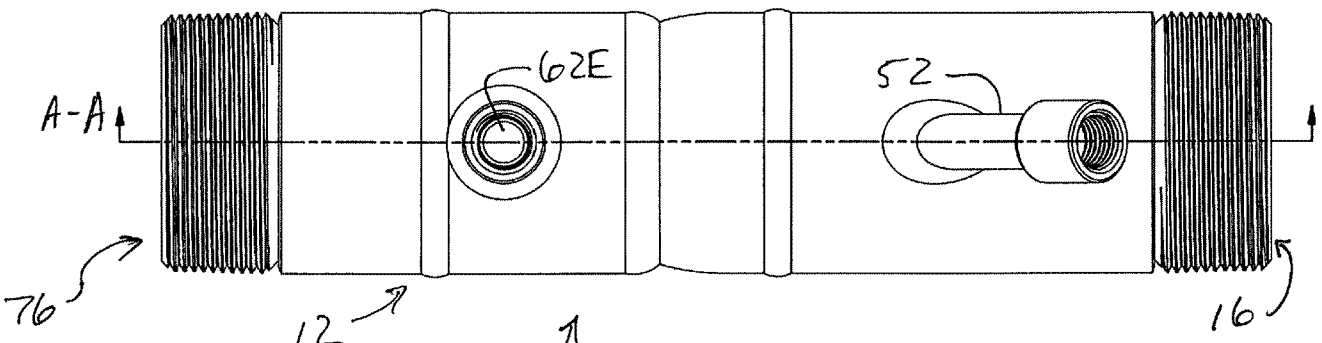
FIG. 1 is a top-view of a first embodiment of a CAF mixing device for a CAF system.
Figure 3:
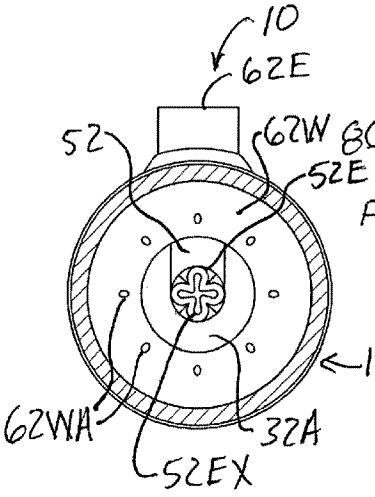
FIG. 3 is a transverse cross-section view of the first embodiment of a CAF mixing device for a CAF system taken from plane B-B of FIG. 2.
Figure 4:
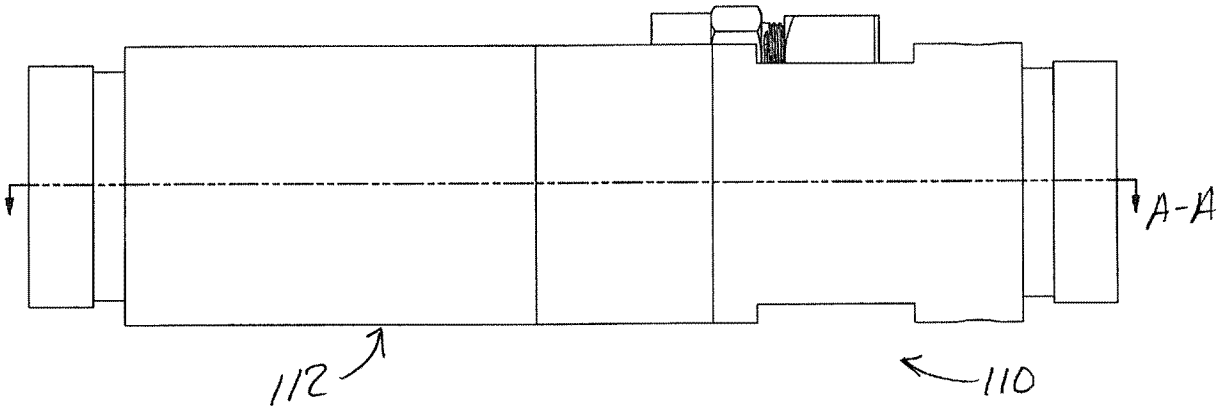
FIG. 4 is a top-view of a second embodiment of a CAF mixing device for a CAF system.

Referring to the figures, FIGS. 1 and 4 provide top-views of first and second embodiments respectively of compressed air foam (CAF) mixing devices 10 and 110. Mixing devices 10 and 110 are suitable for interchangeable use in compressed air foam (CAF) system 210 shown schematically in FIG. 10. In this detailed description, the primary focus will be on CAF mixing device 10 which may be understood as a first embodiment. However, this detailed description will also refer to second embodiment CAF mixing device 110 primarily to explain the differences between the two embodiments. Accordingly, some of the reference numbers shown in FIGS. 4-9 should be understood as indicating a structure in CAF mixing device 110 which is analogous to a structure indicated in FIGS. 1-3. Thus, for example, when element such as inlet portion 22 of first embodiment CAF mixing device 10 is indicated in FIGS. 1-3, element 122 should also be understood as the inlet portion 122 for second embodiment CAF mixing device 110 even though inlet portion 122 of second embodiment CAF mixing device 110 may not be discussed in the detailed description below.

As can be best seen in FIG. 1, CAF mixing device 10 includes a body 12 which presents a longitudinal channel 14 which extends between an inlet 16 an outlet 76. As can be seen in FIG. 2, channel 14 further includes an inlet portion 22, a venturi portion 32 and a deceleration portion 42. As can also be seen in FIGS. 1 and 2, the sidewall of inlet portion 22 is penetrated by an air diffuser tube 52. As is shown in the cross-section view of FIG. 2, air diffuser tube 52 extends into the center of channel 14, through venturi portion 32 and presents a distal end 52E which, in this example, extends into deceleration portion 42. As can be further seen in FIG. 1, at least a portion of venturi portion 32 is surrounded by an air jacket 62. Air jacket 62 is connected to a source of pressurized air and, as can be seen in FIG. 1, air jacket 62, in this example, is bounded by a forward annular wall 62W. As can be best seen in FIG. 2, annular wall is common to deceleration portion 42 and is perforated by a pattern of apertures 62WA. Similarly, diffuser tube 52 is connected to the same source of pressurized air to which air jacket 62 is connected. As can be seen in FIG. 2, air diffuser tube 52 presents an opening 52EX through which pressurized air may be injected into deceleration portion 42. Thus, apertures 62WA and constricted opening 52EX are suitable for injecting jets of pressurized air into deceleration portion 42.

The purpose of a CAF mixing device 10 is to vigorously mix a stream of water soap mixture with pressurized air in a highly turbulent zone so that the maximum number of thin-walled fine soap bubbles are generated for given inputs of water soap mixture and pressurized air. As can be seen in FIGS. 1 and 2, and, as noted above, CAF mixing device 10, in this example, includes generally cylindrical body 12 which presents longitudinal channel 14 which extends between inlet 16 and outlet 76. The skilled reader should understand that a suitable water soap mixture at an appropriate flow rate is presented by a CAF system 5 (schematically diagrammed in FIG. 7). As is well known by those skilled in the art, an appropriate water soap mixture 80W (indicated in FIG. 1) for use for generating CAF typically includes about 1 part soap concentrate per 100 parts water by volume. In this example, the water soap mixture supply could be maintained at a pressure of approximately 100 psi and would be able to deliver flow rates on the order of 100 gpm to 200 gpm. Since the diameter of inlet portion 22 may be on the order of 1.5 to 2.0 inches, the velocity of the water soap mixture may in inlet portion 22 may be between 10 ft/sec and 30 ft/sec. The pressurized air supply should also be capable of delivering pressurized air at a pressure which is comparable to the pressure of the water soap mixture, or approximately 100 psi in this example. In FIG. 2, pressurized air is indicated as 80A.

Figure 2:
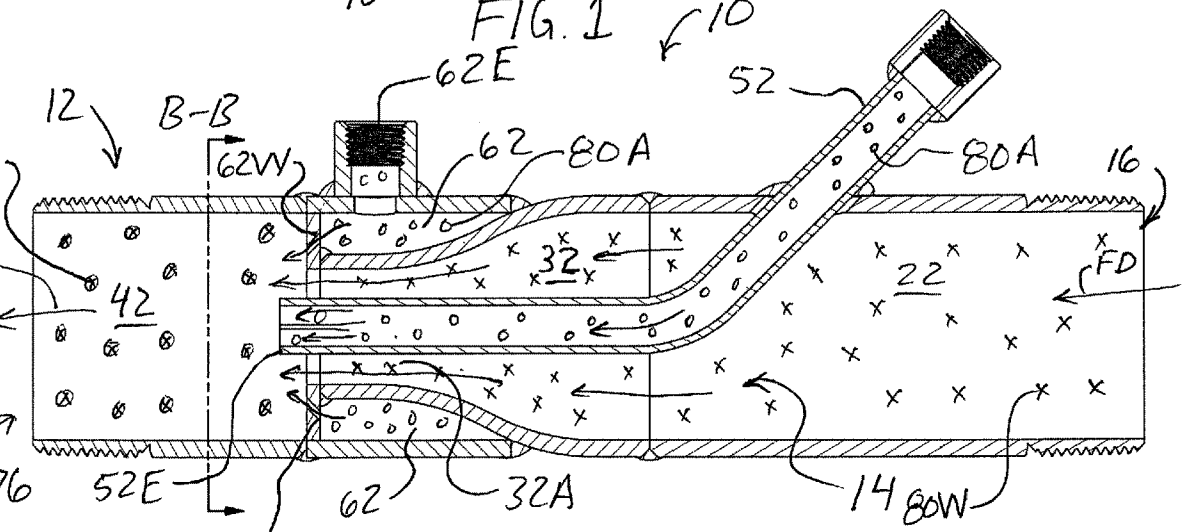
FIG. 2 is a longitudinal cross-section view of the first embodiment of a CAF mixing device for a CAF system taken from plane A-A of FIG. 1.

As can be seen in FIG. 2, a flow of a water soap mixture which flows in the direction indicated by arrow FD enters inlet portion 22. As can be seen in FIG. 2 this flow encounters venturi portion 32 which includes a constricted zone 32A which presents a considerably reduced cross sectional area when compared to inlet portion 22. This is particularly the case because of the presence of air diffuser tube 42 which occupies the center portion of constricted zone 32A. Thus, the cross sectional area which is available for the flow of the water soap mixture in constricted zone 32A may be less than 25% of the cross sectional area of inlet portion 22. Because the water soap mixture is an incompressible fluid and because the velocity of the flow will not exceed the speed of sound in vunturi portion 32, the velocity of the flow in constricted zone 32A of venturi portion 32 must increase in proportion to the decrease in cross sectional area. Further, because the energy of the flow must be conserved, the laws of physics dictate that the pressure in constricted zone 32A must be considerably lower than in inlet portion 22.

Deceleration portion 42 may also be characterized as a mixing chamber. As can be seen in FIG. 2, constricted zone 32A abruptly opens into deceleration portion 42. Preferably, deceleration portion 42 has a third cross sectional area which is comparable to the first cross-section area of inlet portion 22. More preferably, the cross sectional area of deceleration portion 42 is at least as great as the cross sectional area of inlet portion 22. The applicant has been able to observe that when a high speed (on the order of 50 to 80 feet/second) flow of the water soap mixture from constricted zone 32A suddenly emerges into deceleration portion 42 in the presence of a plurality of jets of pressurized air emerging from apertures 62WA and 52EX, what results at least at outlet 76 is a flow of CAF 80F (CAF 80F is indicated in FIG. 2) consisting of very large numbers of very small thin walled soap bubbles, which, because of the initial 1 part per 100 concentration of soap concentrate are comprised mostly of water. CAF 80F has good structure, is persistent, is more likely to blanket and thereby smother some fires and when in contact with sufficient heat converts to steam with a very high rate of efficiency thereby removing heat from a fire with very high efficiency. Those who are skilled in the art will appreciate that CAF 80F can have a range of consistencies ranging between "dry" CAF and "wet" CAF. How a CAF system which includes CAF mixing device 10 (or CAF mixing device 110) may be controlled to generate varying degrees of wetness or dryness of CAF foam will be described in greater detail below.

As can be seen in FIG. 2, the jets of pressurized air are introduced from two pressurized air conduits. The first pressurized air conduit is air jacket 62 which surrounds constricted zone 32A and which shares a common wall with deceleration portion 42. As can be seen in FIG. 2, air jacket 62 is in communication with the pressurized air source and thus is filled with pressurized air 80A. Further, air jacket 62 presents a radial pattern of apertures 62A which extend sharply inwardly from the interior of air jacket 62 to a region of deceleration portion 42 which is adjacent to the outer periphery of the downstream end of constricted zone 32A. This arrangement provides a plurality of air jets which are directed toward the center of deceleration portion 42 where deceleration portion 42 receives the water soap mixture from constricted zone 32A. Note that air diffuser tube 52, as shown in FIG. 2 is disposed such that it passes through the center of constricted zone 32A and terminates at its distal end 52E at the upstream portion of deceleration portion 42. (The same general arrangement holds for air diffuser tube 152 of second embodiment CAF mixing device 110 shown in FIG. 4.) As can be seen in FIG. 3, air distal end 52E of air diffuser tube 52, in this example, presents a crimped, X shaped outlet 52EX for injecting pressurized air into the central portion of deceleration portion 42. As noted above, air diffuser tube 52 is also in communication with the same source of pressurized air 80A as is air jacket 62. The combination of pressurized air being injected from apertures 62A and outlet 52EX promotes the formation of foam as described above.

Figure 5:
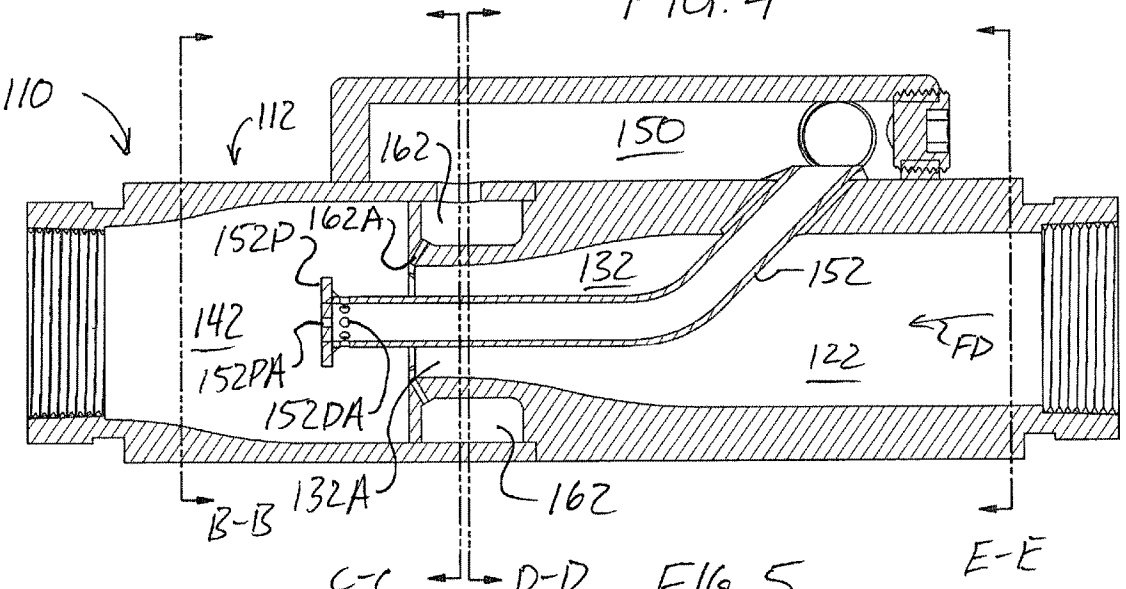
FIG. 5 is a longitudinal cross-section view of a second embodiment of a CAF mixing device for a CAF system taken from plane A-A of FIG. 4.
Figure 8:
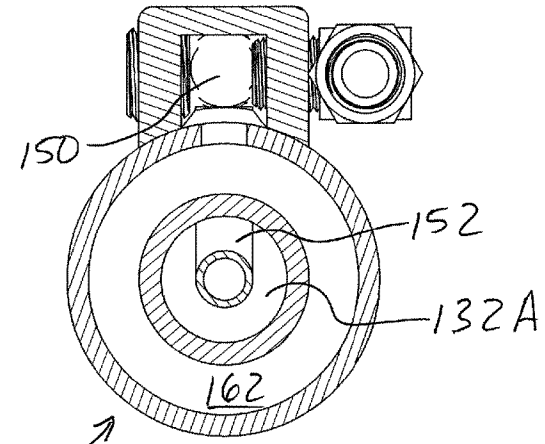
FIG. 8 is a transverse cross-section view of a second embodiment of a CAF mixing device for a CAF system taken from plane D-D of FIG. 5.
Figure 6:
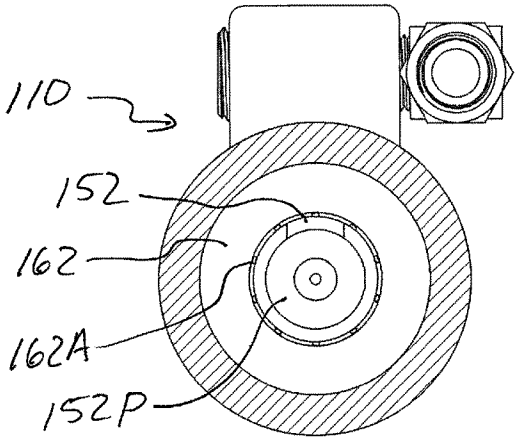
FIG. 6 is a transverse cross-section view of a second embodiment of a CAF mixing device for a CAF system taken from plane B-B of FIG. 5.
Figure 7:
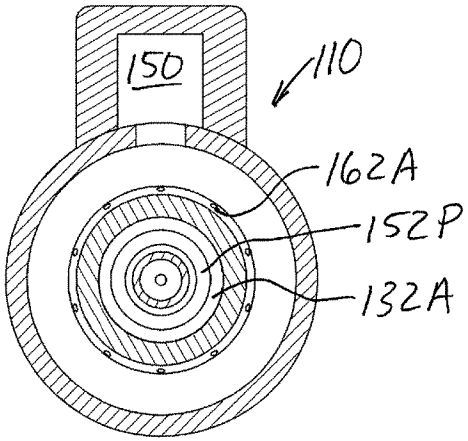
FIG. 7 is a transverse cross-section view of a second embodiment of a CAF mixing device for a CAF system taken from plane C-C of FIG. 5.
Figure 9:
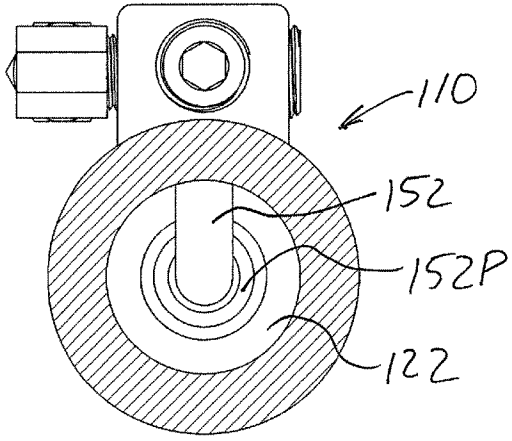
FIG. 9 is a transverse cross-section view of a second embodiment of a CAF mixing device for a CAF system taken from plane E-E of FIG. 5.

The air injection configuration for second embodiment CAF mixing device 110 shown in FIGS. 4-9, is somewhat different from that used in first embodiment CAF mixing device 10. As can be seen in FIG. 5, an air diffuser tube 152 communicates with a plenum 150, which, in this example, is mounted on the side of body 112. Plenum 150 is connected to a pressurized air source. Plenum 150 also communicates with an air jacket 162 which is very similar to air jacket 62 of first embodiment CAF mixing device 10. As can be seen in FIGS. 5 and 6, in CAF mixing device 110, a pattern of apertures 162A communicates between air jacket 162 and deceleration portion 142. As can be best seen in FIG. 5, apertures 162A extend sharply inwardly across the corner defined by the inside wall of air jacket 162 which is common to constricted zone 132A and the downstream wall of air jacket 162 which is common to deceleration portion 142. Thus, apertures 162A slant inwardly and therefore are arranged to inject pressurized air toward the center of deceleration portion 142 in much the same way as apertures 62A slant inwardly to inject air into the center of deceleration portion 42 of first embodiment CAF mixing device 10.

The configuration air diffuser tube 152 is also different for second embodiment CAF mixing device 110. As noted above, air diffuser tube 152 communicates with air plenum 150. Air diffuser tube 152 also enters an inlet portion 122 from the side and is arranged in the center of a venturi portion 132 as was the case with first embodiment CAF mixing device 10 described above. Also, as was the case with CAF device 10, the distal end of air diffuser tube 152 projects into deceleration portion 142. The distal end of air diffuser tube 152 is arranged differently than the distal end of air diffuser tube 52 of first embodiment CAF mixing device 10. A flat end plate 152P is fixed to the end of air diffuser tube 152. In this example, end plate 152P is disc shaped and presents an aperture 152PA which is preferably located at the center of flat end plate 152P. Aperture 152PA is suitable for releasing air from air diffuser tube 152 into deceleration portion 142. In this example, the outer edge of end plate 152P extends radially beyond the outside edge of the distal end of air diffuser tube 152. This radially extending flange further disrupts the flow of the water and soap mixture entering deceleration portion 142 from constricted zone 132A of venturi portion 132. Further, a radial pattern of apertures 152DA are defined in the tube wall at the distal end of diffuser tube 152 adjacent to end plate 152P. Pressurized air is also injected into the turbulent decelerating water soap mixture through apertures 152DA which further aids in the generation of CAF.

Diffuser tube 152 shown in FIG. 4 (or diffuser tube 52 shown in FIG. 1) and air jacket 162 shown in FIG. 4 (or air jacket 62 shown in FIG. 1) may be considered as being merely just a few example structures operable for providing at least one pressurized air conduit which is disposed in close proximity to or adjacent to a deceleration portion such as deceleration portion 142 shown in FIG. 4 (or deceleration portion 42 shown in FIG. 1). In addition to such a pressurized air conduit, what is needed is at least one air injection aperture (and preferably a plurality of apertures) communicating between the at least one pressurized air conduit and the deceleration portion. Preferably, the air injection apertures (if there is more than one) are arranged to inject jets of pressurized air into the turbulent flow of water soap mixture present in the deceleration portion in a distributed fashion so that a water soap foam is generated which preferably consists of very small bubbles having thin walls and good structure. Accordingly, the arrangements of the pressurized air conduits described above for CAF device 10 and CAF device 110 are merely examples which show us how at least one pressurized air conduit may be disposed in proximity to the deceleration portion of a CAF device and how apertures may be defined in the at least one pressurized air conduit which are suitable for injecting pressurized air into the deceleration portion for the purpose of injecting at least one stream of pressurized air into the deceleration portion.

Figure 10:
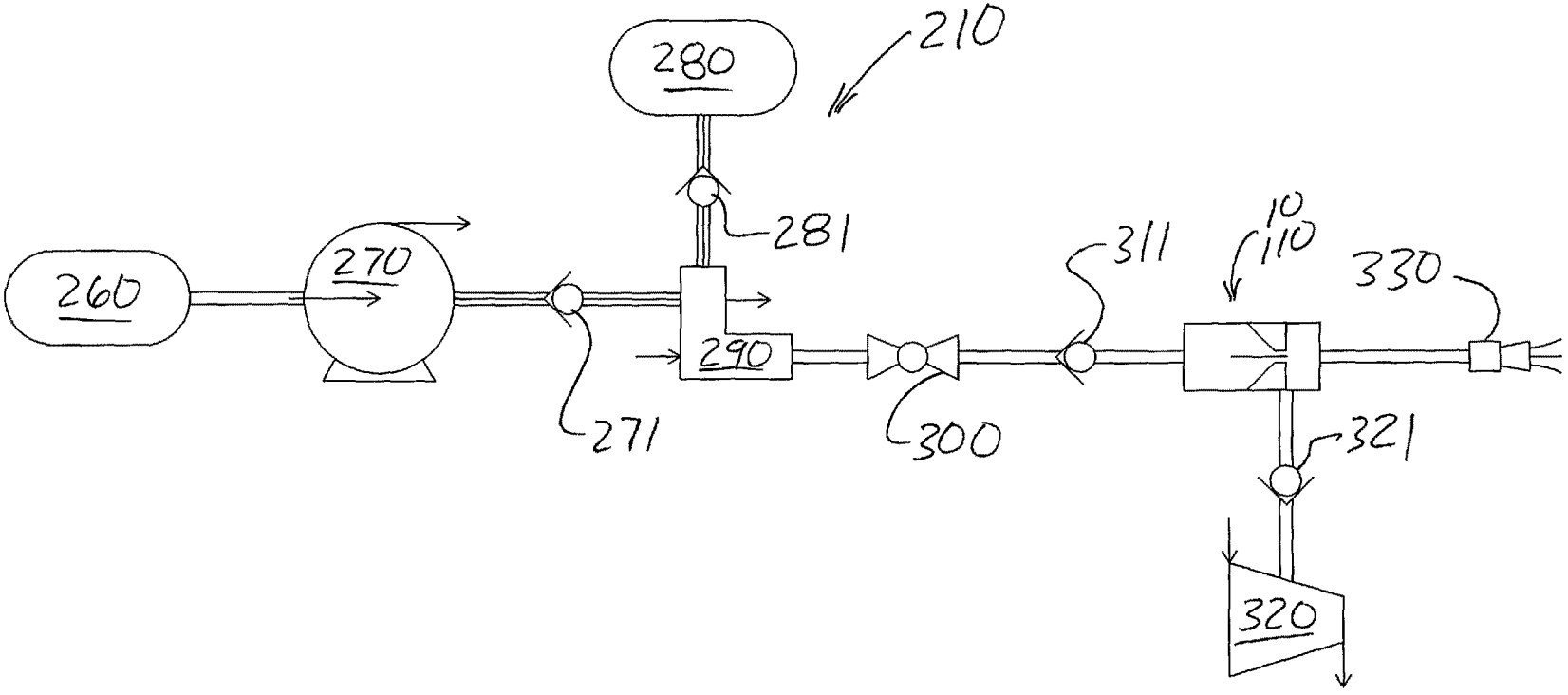
FIG. 10 a schematic diagram of a CAF system which may include either a first embodiment CAF mixing device or a second embodiment CAF mixing device.

CAF device 10 or CAF device 110 is employed within a CAF system which is schematically illustrated in FIG. 10. As can be seen in FIG. 10, CAF system 210 includes a water source 260, a water pressure source 270, a check valve 271, a source of soap concentrate 280, a check valve 281, a soap injection device 290, a valve 300, a check valve 311, a CAF mixing device 10 or 110, a pressurized air source 320, a check valve 321 and a straight bore nozzle mounted on a fire hose 330. As has been noted above, the water source 260 and the water pressure source 270, which will most often comprise a water tank (260) and a pump (270) which are capable of providing water at approximately between 100 gpm and 200 gpm for CAF mixing device having an initial intake diameter of approximately between 1.5 inches and 2.0 inches. The pressurized air source 320 is further adapted to supply pressurized air at a pressure of approximately 100 psig. The various check valves are provided, as would be expected by those skilled in the art, to prevent unwanted backflow into the various upstream elements described above and as shown in FIG. 10. The applicant has found that this arrangement when combined with CAF mixing device 110 generates CAF foam in quantities and with quality which is highly effective for extinguishing fires. Check valves 271, 281, 311 and 321 should be understood as being operable for preventing back flow in the various lines where they are present.

The operation of CAF mixing device 10 or 110 (hereinafter "the mixing device") within the context of a CAF system 210 may be best understood by referring to FIG. 10 and to FIGS. 1-3. In this portion of the detailed description, the structures of first embodiment CAF mixing device 10 will be referred to with occasional parenthetical references to the analogous structures of second embodiment CAF mixing device 110.

Pressurized water and soap concentrate enters the mixing device at the inlet portion 22. Simultaneously, pressurized air is pumped into the device at the air diffuser tube inlet 52 and an air manifold inlet 62E of air manifold 62 which wraps around the acceleration portion 32. Water and soap concentrate flows around the entrance of the air diffuser tube 52 and into the venturi portion 32 and into constricted zone 32A. Upon entering the venturi portion 32, the water and soap concentrate is squeezed into an ever decreasing cross-sectional area spanning the length of the venturi portion 32 until it reaches constricted zone 32A which has a minimum cross sectional area. As noted above, this causes the water and soap concentrate to increase in velocity to maintain the same flow rate through the device.

When the water and soap concentrate reaches the entrance to the deceleration portion 42, the cross-sectional area immediately transitions to at least the size of the inlet portion 22. The applicant believes that this immediate transition from a small area to a larger area causes an extreme pressure volatility and velocity decrease in the water and soap concentrate in deceleration portion 42. At the same instant, pressurized air from both the air manifold 62 wrapping constricted zone 32A and the air diffuser tube 52 is introduced into the fluid flow at the entrance to the deceleration portion 42 causing a turbulent mixing action. Pressurized air exits the air manifold 62 at the apertures 62WA lacing the outside perimeter of the water and soap concentrate flow. Aperatures 52EX of air diffuser tube 52 also inject and disperse pressurized air into the core of the water and soap concentrate flowing past the diffuser tube 52 before entering a violent mixing process near the distal end of air diffuser tube 52. This violent mixing process is increased by areas of vacuum within deceleration portion 42 causing instability which are created near air aperture exits 62WA and 52EX in the deceleration chamber 42.

A similar interaction occurs within mixing device 110. As can be seen in FIG. 4, in mixing device 110, pressurized air is injected into deceleration portion 142 via aperture 152PA in end plate 152P of air diffuser tube 152 and through radial apertures 152DA as well as through apertures 162A which ring the inside downstream corner of air jacket 162. In both cases, namely, in the cases of first embodiment CAF mixing device 10 and second embodiment CAF mixing device 110, multiple jets of pressurized air are injected into a deceleration portion where a flow of a water and soap mixture is rapidly and abruptly decelerating subsequent to passing through a venturi portion.

The applicant believes the mixing (or scrubbing) of the air and water and soap concentrate happens as the result of three operations happening at the same instant inside the deceleration portion 42 (or 142). The CAF mixing device is not, however, limited to this theory of operation. These three operations are as follows: (a) The extreme pressure volatility and decrease in velocity of the water and soap concentrate combined with the multiple introduction points of pressurized air inside and outside the water and soap concentrate stream causes the pressures to equalize and adjust to a new pressure allowing foam bubbles to form. (b) The entrance of pressurized air into the water and soap concentrate at multiple locations inside and outside the water and soap concentrate flow combined with the immediate transition from high velocity to low velocity, multiple locations of relative vacuum are created by the flow of pressurized air and water and soap concentrate into the deceleration portion 42 and the distal end of air diffuser tube 52 creates a violent and turbulent environment of swirling fluid inside the entrance to the deceleration portion 42 (or 142) forcing the mixture of the air and water and soap concentrate. (c) As the water and soap concentrate flows past the pressurized air outlets described above inside deceleration portion 42 (or 142) entrance at high velocity, the much heavier water and soap concentrate molecules pull the pressurized air molecules along with them further into deceleration portion 42. This pulling of the air molecules with the water and soap concentrate molecules and the turbulent environment created by the forced pressure readjustment causes the air and water and soap concentrate to mix.

After CAF is generated in CAF mixing device 10 or 110 as described above, the CAF foam then passes through the piping of the delivery system (not shown), through a length of hose and finally through a nozzle 330 (shown in FIG. 10) for application. No additional piping or hose length is required to mix the CAF once the solution exits the deceleration portion 42 or 142.

The adjustment of the water to soap concentrate to air ratio may be best understood by referring to FIG. 10. The air to water and soap concentrate ratio of the CAF mixture can be adjusted as desired for the application via the valve 300 or via the water pressure source 270 or air pressure source 320 as shown in FIG. 10. If valve 300 is open to a maximum extent, then the more water and soap concentrate will enter inlet chamber 22 (or 122) if the incoming water and soap concentrate pressure and air pressure are held constant. The higher the percentage of water and soap concentrate, the wetter the CAF solution is upon exiting the deceleration portion 42 (or 142). If the valve 100 is constricted to a nearly closed position and very little water and soap concentrate is allowed to enter into the inlet chamber 22 (or 122), the resulting CAF exiting deceleration portion 42 (or 142) will be very dry. A similar degree of wet/dry control can be achieved by decreasing the water pump pressure 270. If the water and soap concentrate pressure is decreased and the air pressure is held constant, the CAF will become dry. Conversely, if the water and soap concentrate pressure is increased and the air pressure is held constant, the CAF will become wet. While adjusting the water pressure source 270 or the air pressure source 320 also allows for adjustment from wet to dry, using the valve 300 and regulating the water and air pressure at the sources, 270 and 320, is the preferred method of changing consistency. This simple method of adjustment allows for infinite possible CAF consistencies within the mechanical constraints of the device. The applicant believes that the acceleration and deceleration of flow and the introduction of pressurized air at both the perimeter and the center of flow inside deceleration chamber 30 entrance the causes the production of a high quality foam across a wide range of inlet solution water and air pressures.

The mixing device is also capable of operating in "full flow" mode when the pressured air source 320 and/or the soap injection system 290 are deactivated. This allows plain water or water and soap concentrate to flow through the device without pressurized air introduction for scenarios where CAF is not preferred.

Experiments performed by the applicant confirm the successful operation of the device described herein. While the present device is defined with reference to CAFS firefighting equipment, it should be understood by those skilled in the art that the invention is not limited as such. The invention finds application wherever it is desirable to produce a high quality mixture of gas and one or more liquids.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A CAF (Compressed Air Foam) mixing device for use in a compressed air CAF mixing apparatus having a source of a water soap mixture and a pressurized air source, the CAF mixing device comprising:

(a) a body which presents a channel which extends from an inlet to an outlet, the inlet being in communication with the source of the water soap mixture and the outlet suitable for presenting compressed air foam suitable for use by a firefighting apparatus, the channel including an inlet portion, a venturi portion and a deceleration portion, (i) the inlet portion extending from the inlet to the venturi portion and having a first cross sectional area, (ii) the venturi portion being in communication with the inlet portion and extending to the deceleration portion, the venturi portion including a constricted zone having a second cross sectional area which is substantially less than the first cross sectional area, (iii) the deceleration portion extending between the constricted zone of the venturi portion and the outlet, the deceleration portion having a third cross sectional area which is substantially greater than the second cross sectional area, (b) at least one air conduit which is in pneumatic communication with the pressurized air source, the at least one air conduit being disposed adjacent to the deceleration portion of the channel, the at least one air conduit presenting at least one aperture which communicates between the at least one air conduit and the deceleration portion, the at least one aperture suitable for injecting pressurized air into the deceleration portion, the at least one air conduit further including an air diffuser tube which extends at least through the constricted zone of the venturi portion and so that the constricted zone of the venturi portion has an annular cross section, whereby, the water soap mixture enters the inlet portion at a first velocity, accelerates in the venturi portion to a second velocity which is higher than the first velocity then decelerates in a turbulent fashion in the deceleration portion as pressurized air is introduced into the deceleration portion such that water soap foam is generated within the device and discharged from the outlet thereby producing compressed air foam which is effective for fighting fires.

2. The CAF mixing device of claim 1, wherein:

the air diffuser tube has a distal end, the air diffuser tube entering through an outside wall of the inlet portion and extending generally though a center of the constricted zone of the venturi portion and into the deceleration portion, the air diffuser tube presenting at least one diffuser tube aperture near the distal end thereof for injecting pressurized air into the deceleration portion.

3. The CAF mixing device of claim 2, wherein:

the at least one air conduit further includes an air jacket arranged around the venturi portion, the air jacket in communication with the source of pressurized air and presenting a plurality of apertures that are in communication with the deceleration portion for injecting pressurized air into the deceleration portion.

4. The CAF mixing device of claim 3, wherein:

the inlet portion, the venturi portion, air diffuser tube and the deceleration portion all have generally circular cross sections and the diameter of the constricted zone of the venturi portion is generally half that of the inlet portion, the outside diameter of the diffuser tube is generally half that of the constricted zone and the diameter of the deceleration portion is generally the same as the inlet portion.

5. The CAF mixing device of claim 3, wherein:

the distal end of the air diffuser tube extends into the deceleration portion, the distal end of the air diffuser tube is capped by an end plate and at least one opening disposed near the distal end of the air diffuser tube is the plurality of apertures disposed around the periphery of the air diffuser tube adjacent to the end plate and the end plate further presents an aperture for injecting pressurized air into the deceleration portion.

6. The CAF mixing device of claim 1, wherein:

the at least one air conduit includes an air jacket arranged around the venturi portion, the air jacket in communication with the source of pressurized air and presenting a plurality of apertures that are in communication with the deceleration portion for injecting pressurized air into the deceleration portion.

7. A CAF (Compressed Air Foam) mixing device for use in a compressed air CAF mixing apparatus having a source of a water soap mixture and a pressurized air source, the CAF mixing device comprising:

(a) a body which presents a channel which extends from an inlet to an outlet, the inlet being in communication with the source of the water soap mixture and the outlet suitable for presenting compressed air foam suitable for use by a firefighting apparatus, the channel including an inlet portion, a venturi portion and a deceleration portion, (i) the inlet portion extending from the inlet and having a first cross sectional area, (ii) the venturi portion being in communication with the inlet portion, the venturi portion including a transition zone and a constricted zone, the constricted zone having a second cross sectional area which is substantially less than the first cross sectional area and the transition zone extending between the inlet portion and the constricted zone, the cross sectional area of the transition zone progressively decreasing between the inlet portion and the constricted zone, (iii) the deceleration portion being in communication with the constricted zone of the venturi portion, the deceleration portion having a third cross sectional area which is substantially greater than the second cross sectional area, the deceleration portion also being in communication with the outlet, (b) an air jacket at least partially surrounding at least the constricted zone of the venturi portion, the air jacket in communication with the pressurized air source, the air jacket presenting a plurality of apertures which communicate between the air jacket and the deceleration portion such that pressurized air is able to be injected therethrough from the air jacket into the deceleration portion, (c) an air diffuser tube having a distal end, the air diffuser tube communicating at least indirectly with the pressurized air source and with the deceleration portion, the air diffuser tube also being disposed within at least the constricted zone of the venturi portion, the air diffuser tube having at least one aperture at the distal end thereof such that pressurized air from the air diffuser tube is able to be injected into the deceleration portion, whereby, the water soap mixture enters the inlet portion at a first velocity, accelerates in the venturi portion to a second velocity which is higher than the first velocity then decelerates in a turbulent fashion in the deceleration portion as pressurized air is injected into the deceleration portion from the air jacket and the air diffuser tube such that water soap foam is generated within the device and discharged from the outlet thereby generating compressed air foam which is effective for fighting fires.

8. The CAF mixing device of claim 7, wherein:

the inlet portion includes an outside wall and the air diffuser tube enters through the outside wall of the inlet portion and extends though the constricted zone of the venturi portion and into the deceleration portion so that the constricted zone of the venturi portion has an annular cross section.

9. The CAF mixing device of claim 7, wherein:

the inlet portion, the venturi portion, air diffuser tube and the deceleration portion all have generally circular cross sections and the diameter of the constricted zone of the venturi portion is generally half that of the inlet portion, the outside diameter of the diffuser tube is generally half that of the constricted zone and the diameter of the deceleration portion is generally the same as the inlet portion.

10. The CAF mixing device of claim 7, wherein:

the distal end of the diffuser tube extends into the deceleration portion and the at least one opening disposed near the distal end of the air diffuser tube is at the distal end of the air diffuser tube.

11. The CAF mixing device of claim 7, wherein:

the distal end of the air diffuser tube extends into the deceleration portion, and wherein the distal end of the air diffuser tube is capped by a plate and the at least one opening disposed near the distal end of the air diffuser tube is a plurality of apertures disposed around the air diffuser tube adjacent to the plate.

12. The CAF mixing device of claim 7, wherein:

the distal end of the air diffuser tube extends into the deceleration portion, the distal end of the air diffuser tube is covered by a plate which has a flange which extends outside the diameter of the distal end of the air diffuser tube, and the at least one opening disposed near the distal end of the air diffuser tube includes an aperture in the plate which communicates with the interior of the air diffuser tube and a plurality of apertures disposed around the periphery of the distal end of air diffuser tube adjacent to the plate, the aperture in the plate and the plurality of apertures disposed around the periphery of the distal end of the air diffuser tube being suitable for injecting jets of pressurized air into the deceleration portion.

13. A CAF (Compressed Air Foam) mixing device for use in a compressed air CAF mixing apparatus having a source of a water soap mixture and a pressurized air source, the CAF mixing device comprising:

(a) a body which presents a channel which extends from an inlet to an outlet, the inlet being in communication with the source of the water soap mixture and the outlet suitable for presenting compressed air foam suitable for use by a firefighting apparatus, the channel including an inlet portion, a venturi portion and a deceleration portion, (i) the inlet portion extending from the inlet and having a first cross sectional area, (ii) the venturi portion being in communication with the inlet portion, the venturi portion including a transition zone and a constricted zone, the constricted zone having a second cross sectional area which is substantially less than the first cross sectional area and the transition zone extending between the inlet portion and the constricted zone, the cross sectional area of the transition zone progressively decreasing between the inlet portion and the constricted zone, (iii) the deceleration portion being in communication with the constricted zone of the venturi portion, the deceleration portion having a third cross sectional area which is substantially greater than the second cross sectional area, the deceleration portion also being in communication with the outlet, (b) an air plenum which is in communication with the source of pressurized air, (c) an air jacket surrounding at least the constricted zone of the venturi portion, the air jacket in communication with the air plenum, the air jacket presenting a plurality of apertures which communicate between the air jacket and the deceleration portion such that pressurized air is able to be injected therethrough from the air jacket into the deceleration portion, (d) an air diffuser tube which communicates with the air plenum and with the deceleration portion, the air diffuser tube also being disposed within at least the constricted zone of the venturi portion, a distal end of the air diffuser tube is covered by a plate which has a flange which extends outside a diameter of the distal end of the air diffuser tube, the plate presenting an aperture which communicates with the interior of the air diffuser tube and a plurality of apertures disposed around the periphery of the distal end of air diffuser tube adjacent to the plate, the aperture in the plate and the plurality of apertures disposed around the periphery of the distal end of the air diffuser tube being suitable for injecting pressurized air into the deceleration portion, whereby, the water soap mixture enters the inlet portion at a first velocity, accelerates in the venturi portion to a second velocity which is higher than the first velocity then decelerates in a turbulent fashion in the deceleration portion as pressurized air is injected into the deceleration portion from the air jacket and the air diffuser tube such that water soap foam is generated within the device and discharged from the outlet thereby generating compressed air foam which is effective for fighting fires.

14. A CAF mixing device of claim 13, wherein:

the inlet portion, the venturi portion, air diffuser tube and the deceleration portion all have generally circular cross sections and the diameter of the constricted zone of the venturi portion is generally half that of the inlet portion, the outside diameter of the diffuser tube is generally half that of the constricted zone and the diameter of the deceleration portion is generally the same as the inlet portion.

* * * * *